US012338019B2

(12) United States Patent
Sim

(10) Patent No.: US 12,338,019 B2
(45) Date of Patent: Jun. 24, 2025

(54) PACKING APPARATUS FOR LOADING COMPRESSIBLE ARTICLES

(71) Applicant: SKY-TAG ROBOTICS SDN. BHD., Simpang Ampat (MY)

(72) Inventor: Chooi Beng Sim, Bukit Mertajam (MY)

(73) Assignee: SKY-TAG ROBOTICS SDN. BHD., Simpang Ampat (MY)

( * ) Notice: Subject to any disclaimer, the term of this patent is extended or adjusted under 35 U.S.C. 154(b) by 0 days.

(21) Appl. No.: 17/926,027

(22) PCT Filed: May 27, 2022

(86) PCT No.: PCT/MY2022/050041
§ 371 (c)(1),
(2) Date: Nov. 17, 2022

(87) PCT Pub. No.: WO2023/027575
PCT Pub. Date: Mar. 2, 2023

(65) Prior Publication Data

US 2024/0228090 A1 Jul. 11, 2024

(30) Foreign Application Priority Data

Aug. 27, 2021 (MY) ..... PI 2021004942

(51) Int. Cl.
*B65B 31/02* (2006.01)
*B65B 5/06* (2006.01)
(Continued)

(52) U.S. Cl.
CPC ..... *B65B 31/025* (2013.01); *B65B 5/06* (2013.01); *B65B 7/20* (2013.01); *B65B 7/26* (2013.01); *B65B 35/36* (2013.01); *B65B 43/52* (2013.01)

(58) Field of Classification Search
CPC ..... B65B 31/025; B65B 5/06; B65B 7/20; B65B 7/26; B65B 35/36; B65B 43/52
See application file for complete search history.

(56) References Cited

U.S. PATENT DOCUMENTS 2,923,112 A * 2/1960 Harker ..... B65B 7/20 53/376.5
3,022,615 A * 2/1962 Schroeder ..... B65B 61/02 53/496
(Continued)

FOREIGN PATENT DOCUMENTS

CN 202728596 2/2013
CN 203318808 12/2013
(Continued)

OTHER PUBLICATIONS

International Search Report Dated Aug. 11, 2022.
(Continued)

*Primary Examiner* — Gloria R Weeks
*Assistant Examiner* — Katie L Gerth
(74) *Attorney, Agent, or Firm* — Preston Smirman; SMIRMAN IP LAW, PLLC

(57) ABSTRACT

A packaging apparatus for loading compressible articles, the apparatus comprising loading means (1, 2) for loading a stack of compressible articles into an open ended carton sleeve (3), compressing means (5) to compress the ends of the stack of articles when loaded into the sleeve (3), and folding means (6, 7, 8) to close the ends of the sleeve, wherein the loading means (1, 2) comprises a first clamping arm (1) and a second clamping arm (2), and wherein the compressing means (5) comprises pushers to press into the sleeve (3) onto the opposed ends of the loaded stack, and
(Continued)

wherein the folding means (6, 7, 8) comprises folding elements to fold end closure panels of the sleeve (3) to close said sleeve.

8 Claims, 4 Drawing Sheets

(51) Int. Cl.

| | |
|---|---|
| ***B65B 7/20*** | (2006.01) |
| ***B65B 7/26*** | (2006.01) |
| ***B65B 35/36*** | (2006.01) |
| ***B65B 43/52*** | (2006.01) |

(56) References Cited

U.S. PATENT DOCUMENTS

| | | | | |
|---|---|---|---|---|
| 3,139,714 | A * | 7/1964 | Hall | B65B 5/061 53/529 |
| 4,067,172 | A * | 1/1978 | Paules | B65B 59/00 53/506 |
| 4,517,791 | A * | 5/1985 | Focke | B65B 5/06 198/374 |
| 5,175,976 | A * | 1/1993 | Petry | B65B 39/12 53/566 |
| 6,202,392 | B1 * | 3/2001 | Greenwell | B65B 25/141 53/566 |
| 11,377,248 | B2 * | 7/2022 | Moncrief | B65B 5/024 |
| 11,713,148 | B2 * | 8/2023 | Rapparini | B65B 43/265 53/456 |
| 2015/0329231 | A1 * | 11/2015 | Moncrief | B65B 59/001 53/543 |
| 2019/0263547 | A1 * | 8/2019 | Tatsukawa | B65B 7/2864 |
| 2019/0322066 | A1 * | 10/2019 | Engelhardt | B65B 5/061 |
| 2022/0081136 | A1 * | 3/2022 | Engelhardt | B65B 5/061 |
| 2024/0101290 | A1 * | 3/2024 | Tan | B65B 7/20 |

FOREIGN PATENT DOCUMENTS

| | | |
|---|---|---|
| CN | 203667046 | 6/2014 |
| CN | 103332346 | 2/2015 |
| CN | 112158395 | 1/2021 |
| CN | 112960186 | 6/2021 |
| WO | 2013117310 | 8/2013 |
| WO | 2019221594 | 11/2019 |

OTHER PUBLICATIONS

Written Opinion of International Searching Authority Dated Aug. 11, 2022.
Machine Translation of CN203318808.
Machine Translation of CN112158395.
Machine Translation of CN203667046.
Machine Translation of CN202728596.
Machine Translation of CN112960186.
Machine Translation of CN103332346.

* cited by examiner

PACKING APPARATUS FOR LOADING COMPRESSIBLE ARTICLES

CROSS-REFERENCE TO RELATED APPLICATION

The instant application is a national phase of PCT International Application No. PCT/MY2022/050041 filed May 27, 2022, and claims priority to Malaysian Patent Application Serial No. PI 2021004942 filed Aug. 27, 2021, the entire specifications of both of which are expressly incorporated herein by reference.

FIELD OF INVENTION

The present invention relates to a packing apparatus, more particularly a packing apparatus for loading compressible articles such as surgical gloves into an open ended carton sleeve.

BACKGROUND OF THE INVENTION

In a packaging production line, most elastomeric articles such as examination gloves, surgical gloves or the likes are stacked and stuffed into a packaging carton prior to being sent off for sealing and packing in another station. The problem arises when the stack of gloves is not compressed to remove any air in the packaging carton, causing the stack of gloves to expand the packaging carton, which makes sealing of the packaging carton more cumbersome.

Many technologies have been implemented to improve on the packing apparatus. A Chinese utility model with publication no. CN203318808U discloses a glove shaping and boxing mechanism comprising a base, a mounting platform, and a glove placing plate, wherein the glove placing plate is arranged on the mounting platform; transverse compression plates are arranged at two sides of the glove placing plate respectively; the sides of the transverse compression plates are connected with transverse driving devices; one end of the glove placing plate is connected with a longitudinal pushing plate; a boxing pushing plate is arranged at one side of the longitudinal pushing plate; the longitudinal pushing plate and the boxing pushing plate are connected with a longitudinal driving device respectively; a vertical pushing plate is arranged above the glove placing plate and is connected with a vertical driving cylinder; the vertical driving cylinder is arranged on a bracket along the longitudinal direction in a sliding mode; and the bracket is arranged on the mounting platform. Another Chinese patent with publication no. CN112158395A discloses a continuous full-automatic glove box packing machine which comprises a frame body, wherein a transverse conveying device is arranged on the frame body along the conveying direction, the two box sealing devices are respectively positioned on two sides of the frame body and the material taking device can be used for realizing the absorption and the expansion of a packing box. Yet another Chinese utility model with publication no. CN203667046U discloses an automatic glove packaging machine comprising a machine frame, a feeding box, a material pushing plate, an inner box body driving mechanism and an auxiliary pushing compressing device, whereby the feeding box is fixed onto the machine frame. The feeding box comprises an outer box body and an inner bod body arranged in the outer box in a sliding mode. An opening is formed on the upper portion of the outer box body, so that glove feeding is convenient. The front end of the outer box body and the front end of the inner box body are also opened, so that material discharging is convenient.

Another technology as disclosed in a Chinese utility model with publication no. CN202728596U recites a device for quickly sending finished gloves into packing boxes, which comprises a glove transition box and a transition box support groove, wherein the glove transition box is provided with a movable cover plate and installed on inner guide rails on both sides of the transition box support groove. When the device is operated, the gloves are compressed and stacked into a tube structure which is formed by the glove transition box and movable cover plate, wherein openings are formed in both ends of the tube structure, and the periphery of the tube structure is sealed, then the glove transition box is pushed into the glove packing boxes, and a glove stopper blocks the gloves before the glove transition box is pulled out, so that the gloves are kept in the glove packing boxes.

The aforementioned prior art illustrates the various configurations of packing apparatus for compressible articles, particularly gloves, which is the main key of the proposed invention. However, a drawback arises as previously mentioned in which the stack of articles or gloves that are packed in the packaging carton are not compressed to remove any air pressure built up within the carton sleeve. The proposed invention overcomes this problem by not only clamping onto the stack of articles, but also compressing said stack before sealing the packaging.

SUMMARY OF INVENTION

An object of the present invention is to provide a packing apparatus which can load a stack of articles into a sleeve or a box with greater ease. Another object of the present invention is to also prevent air pressure built up within the sleeve.

In one aspect of the present invention, there is provided a packing apparatus for loading compressible articles, the apparatus comprising loading means for loading a stack of compressible articles into an open ended carton sleeve, compressing means to compress ends of the stack of articles when loaded into the sleeve, and folding means to close the ends of the sleeve, wherein the loading means comprises a first clamping arm adapted to clamp one end of the stack of articles sufficiently so that the first clamping arm can load the compressed stack through one end of the sleeve, a second clamping arm adapted to enter the opposite end of the sleeve to clamp the opposite end of the stack while the first clamping arm is released from the stack and withdrawn from the sleeve, the second clamping arm also being adapted to release and with draw from the sleeve, and wherein the compressing means comprises pushers to press into the sleeve onto the opposed ends of the loaded stack, and wherein the folding means comprises folding elements to fold end closure panels of the sleeve to close said carton.

Preferably, the packing apparatus further comprising a package feeder for feeding the open ended carton sleeves into a conveyor line.

Preferably, the folding elements include a first folding element, a second folding element, and a third folding element.

Preferably, the first folding element is a pair of downwardly angled elongate members.

Preferably, the first folding element is configured to fold opposing lateral sides of a bottom flap of each end closure panels of the sleeve.

Preferably, the second folding element is configured to push the bottom flap of the end closure panels of the sleeve upwards in a vertical direction.

Preferably, the third folding element is configured to push the bottom flap of the end closure panels of the sleeve inwards and holds said panels in place for a predetermined period.

In another aspect of the present invention, there is provided a method for loading compressible articles using the packing apparatus, the method comprising the steps of loading a stack of compressible articles into an open ended carton sleeve by loading means, compressing ends of the stack of articles when loaded into the sleeve by compressing means, and closing ends of the sleeve by folding means, wherein the loading means comprises a first clamping arm adapted to clamp one end of the stack of articles sufficiently so that the first clamping arm can load the compressed stack through one end of the sleeve, a second clamping arm adapted to enter the opposite end of the sleeve to clamp the opposite end of the stack while the first clamping arm is released from the stack and withdrawn from the sleeve, the second clamping arm also being adapted to release and with draw from the sleeve, and wherein the compressing means comprises pushers to press into the sleeve onto the opposed ends of the loaded stack, and wherein the folding means comprises folding elements to fold end closure panels of the sleeve to close said carton.

One skilled in the art will readily appreciate that the present invention is well adapted to carry out the objects and obtain the ends and advantages mentioned, as well as those inherent therein. The embodiment described herein is not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

Hereinafter, the invention shall be described according to the preferred embodiments of the present invention and by referring to the accompanying description and drawings. However, it is to be understood that limiting the description to the preferred embodiments of the invention is merely to facilitate discussion of the present invention and it is envisioned that those skilled in the art may devise various modifications without departing from the scope of the appended claim.

Figure 1:
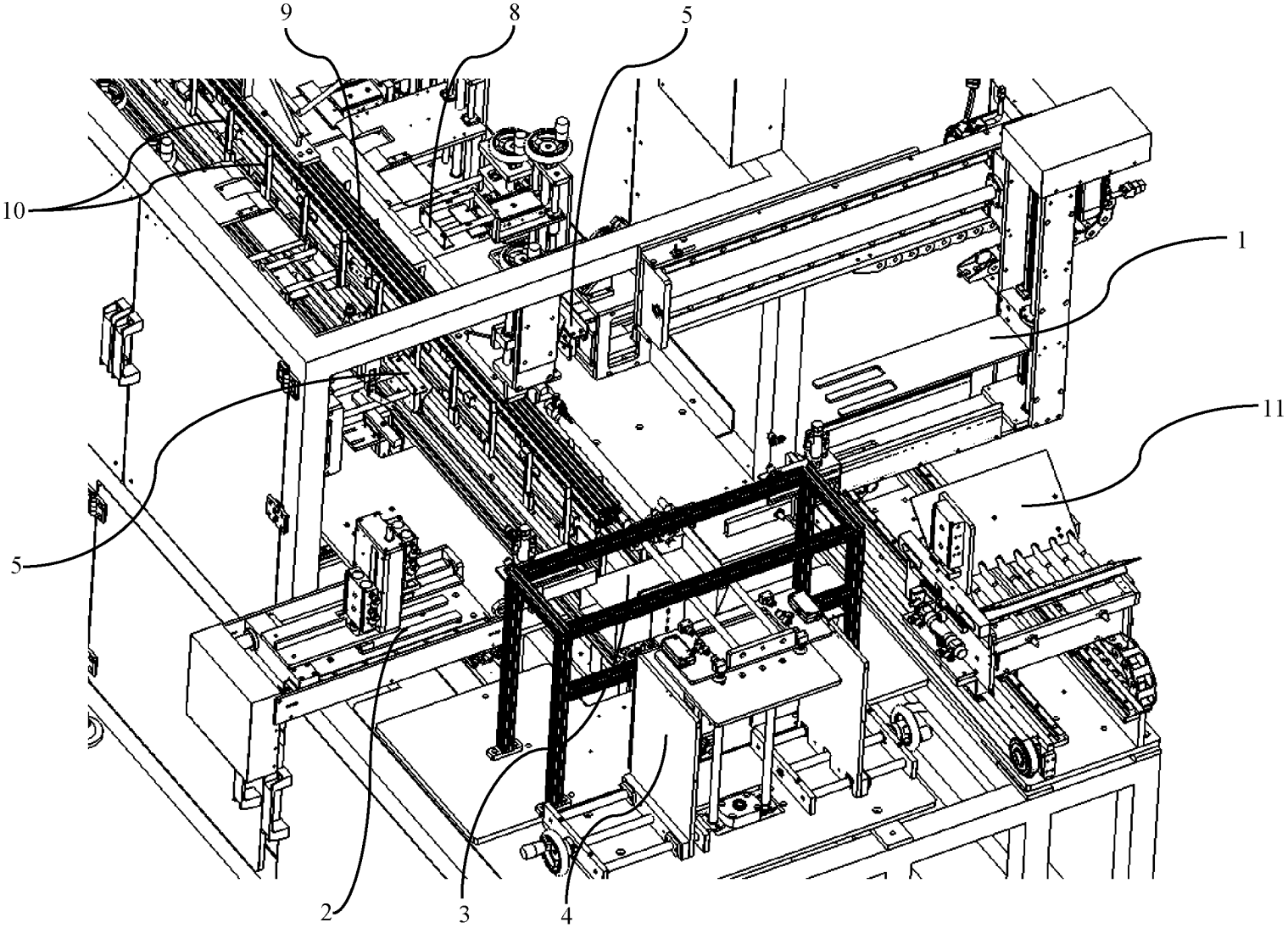
FIG. 1 is a diagram illustrating an isometric view of a packing apparatus for loading compressible articles.

FIG. 1 illustrates a preferred embodiment of a packing apparatus for loading compressible articles, the apparatus comprising a loading means 1, 2, a compressing means 5, and a folding means 6, 7, 8, all of which are disposed one after the other along a conveyor 9 or production line where the compressible articles are manufactured. The compressible articles are preferably gloves, which may include, but not limited to, surgical gloves, nitrile gloves, latex gloves or any combination thereof. In a preferred embodiment, the loading means 1, 2 is configured for loading a stack of compressible articles into an open ended carton sleeve 3, in which the sleeve 3 may be a box made from any suitable material such as paper, cardboard, plastic or the likes. Preferably, the sleeve 3 has a first open end and a second open end, whereby each end comprises at least one end enclosure panel having a top flap and a bottom flap that are foldable between an open configuration and a closed configuration.

Figure 2:
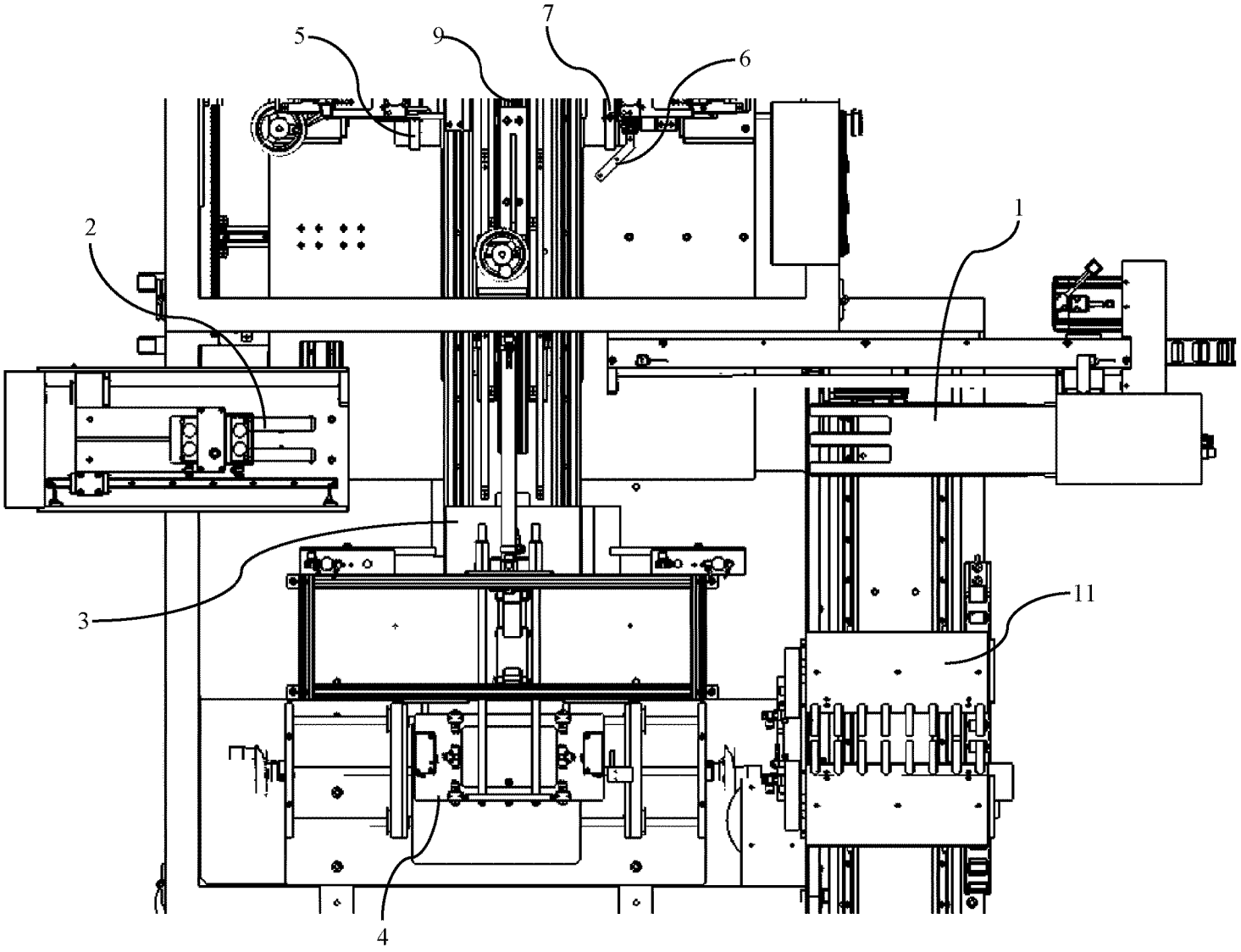
FIG. 2 is a diagram illustrating a top view of the packing apparatus.
Figure 3:
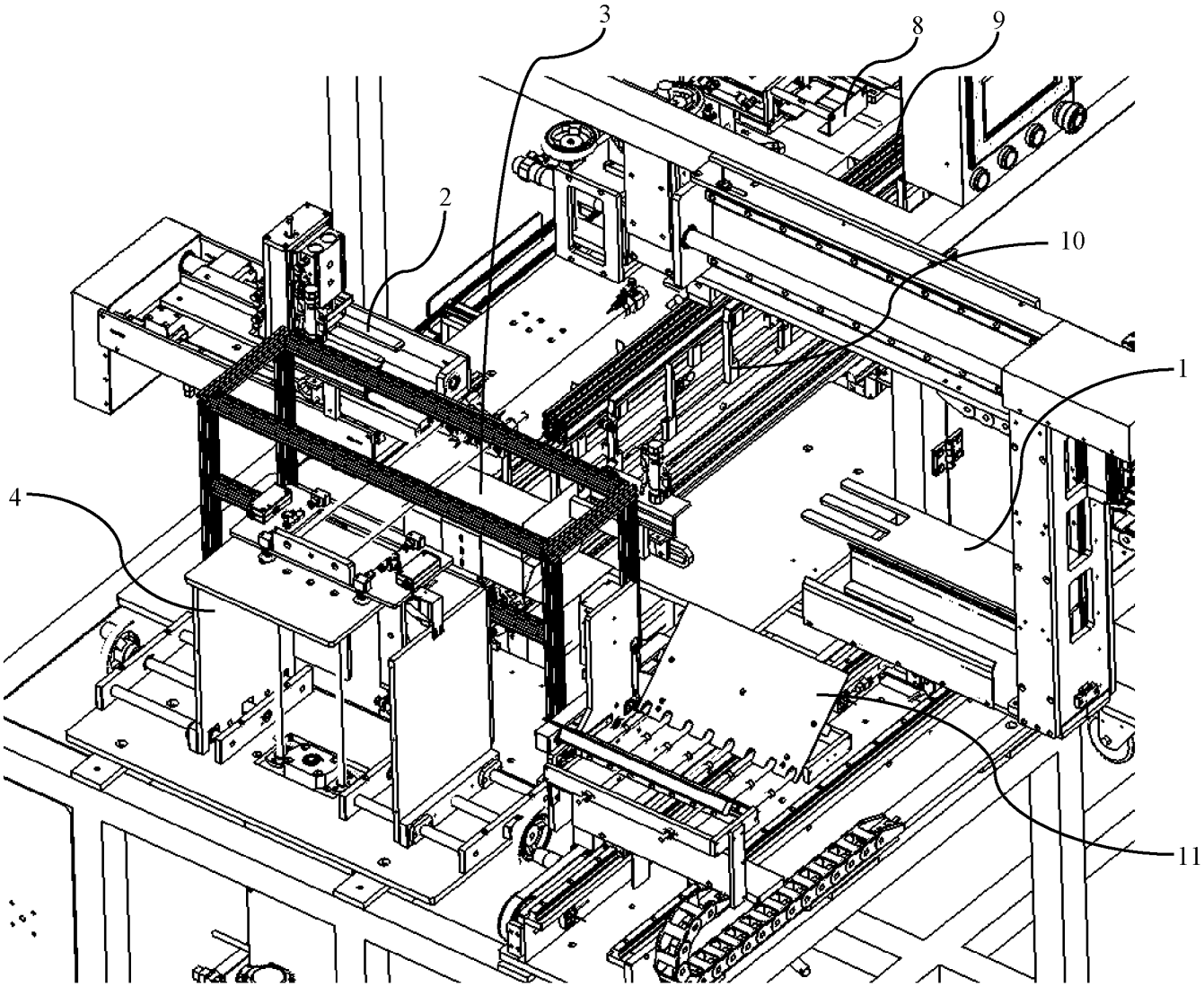
FIG. 3 is a diagram illustrating another isometric view of the packing apparatus.

Referring to any one of FIG. 1 to FIG. 3, the sleeve 3 may be fed into the conveyor 9, either or both manually and automatically, via a packaging feeder 4 disposed at a starting end of the conveyor 9. The sleeve 3 may be preloaded before operation so the feeding of the sleeve 3 onto the conveyor 9 may be automated. Additionally, the conveyor includes a plurality of moveable protrusions 10 evenly spaced apart from each other, preferably similar to the sleeve 3 width, whereby the protrusions 10 secures the sleeve 3 in position during operation, and also being able to move in both horizontal and vertical directions, such that the moveable protrusions 10 may displace the sleeve 3 along the conveyor 9, stopping at each stage of operation which will be discussed further herein.

In a particular embodiment, the loading means 1, 2 comprises a first clamping arm 1 adapted to clamp one end of the stack of articles sufficiently so that the first clamping arm 1 can load the stack of articles through one end of the sleeve 3. Preferably, the stack of articles is received by the first clamping arm 1 from a first end effector 11 disposed adjacent to the packaging feeder 4. A second clamping arm 2 is adapted to enter the second open end of the sleeve 3 prior to the first clamping arm 1 entering the sleeve 3 from the first open end of said sleeve 3. Upon loading the stack of articles into the sleeve 3, the second clamping arm 2 may clamp the opposite end of the stack while the first clamping arm 1 is released from the stack, subsequently being withdrawn from the sleeve 3, and wherein the second clamping arm 2 is also adapted to release the stack and withdraw from the sleeve 3 shortly thereafter. The sleeve 3 may then be displaced down the conveyor 9 to the compressing means 5.

In a preferred embodiment, the compressing means 5 operate by compressing ends of the stack of articles which were loaded into the sleeve 3, in which the compressing means comprises pushers to press into the sleeve 3 from opposite ends of the loaded stack of articles for discharging air from said stack of articles. Preferably, the pushers may engage the loaded stack of articles and hold said stack in position for a predetermined period, preferably for one or two seconds before disengaging from said loaded stack. This, in turn, ensures that there are no articles that overhang past end closure panels of the sleeve 3 at each opposing ends, in addition to potentially remove any air pressure built up within the sleeve 3. Once the compressing means 5 have fully withdrawn from the stack of articles, the sleeve 3 may then be displaced down the conveyor 9.

In a particular embodiment, the folding means 6, 7, 8 of the packing apparatus are configured to close the ends of the sleeve 3 which has the end closure panels comprising the top flap and the bottom flap, wherein the folding means 6, 7, 8 comprises folding elements which include, but not limited to, a first folding element 6, a second folding element 7, and a third folding element 8. The first folding element 6 comprises of at least one pair of downwardly angled elongate members disposed at opposite ends of the sleeve 3, the first folding element 6 is configured to fold opposing lateral sides of the bottom flap of the end closure panels, in a pinching manner, upon the compressing means 5 disengaging from the stack of articles. Concurrently, the second folding element 7 is configured to push the bottom flap upwards for a predetermined distance before reverting to its original position. Subsequently, the sleeve 3 which is partially closed, is moved further down the conveyor 9 to where the third folding element 8 is located, such that the third folding element 8, similar to the compressing means 5, comprises a pusher which pushes the bottom flap into the sleeve 3 and holds the flap for a predetermined period before the sleeve 3 is moved to the next station. The top flap which has not been folded in may then be folded into the bottom flap manually by the operator before the closed sleeve 3 is transported away for further packing and storage.

Figure 4:
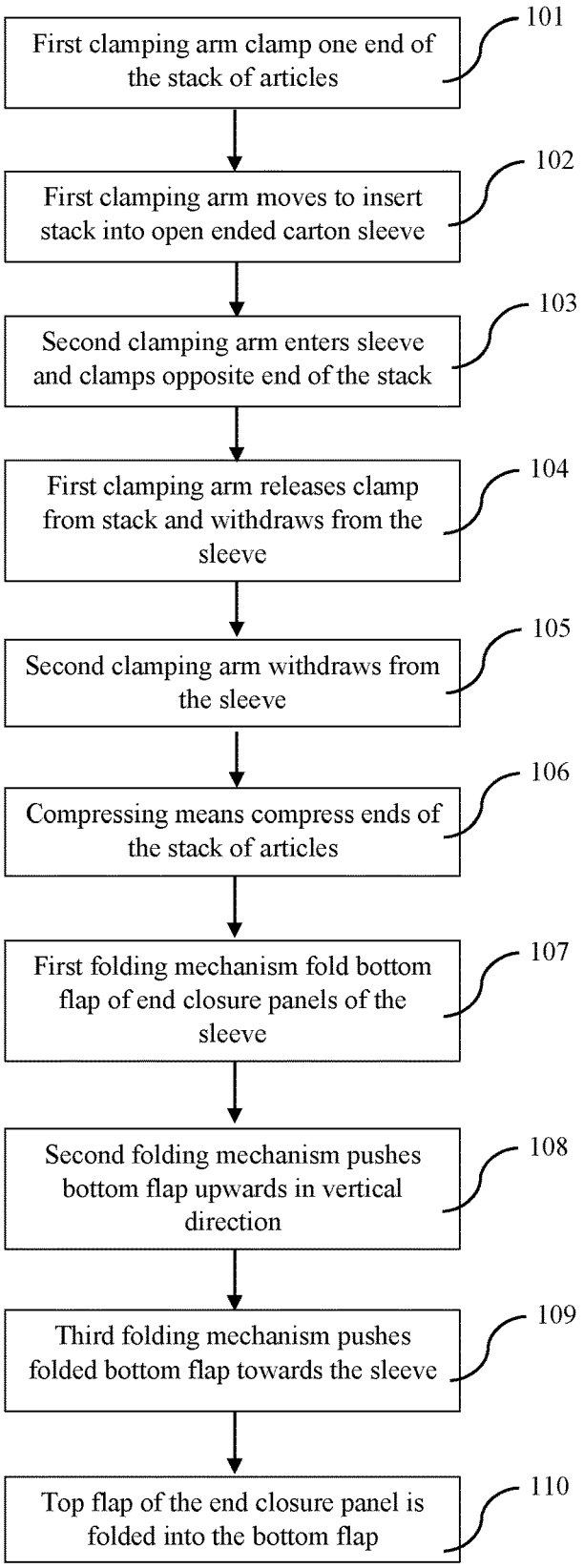
FIG. 4 is a flow chart illustrating a method for loading a stack of compressible articles into an open ended carton sleeve.

In a further aspect of the invention, the packing apparatus may be used for executing a series of steps to load the stack of compressible articles into the open ended carton sleeve 3. With reference to FIG. 4, the loading means 1, 2 loads the stack of compressible articles into the opened ended carton sleeve 3 by initially having the first clamping arm 1 clamp one end of the stack at Step 101 and inserting said stack into the sleeve 3 at Step 102. At Step 103, the second clamping arm 2 is actuated to enter the sleeve 3 and clamp onto the opposite end of the stack. At Step 104, the first clamping arm 1 releases its clamp onto the stack and is withdrawn from the sleeve 3. At Step 105, the second clamping arm 2 is then withdrawn from the sleeve 3 as well and the sleeve 3 moves down the conveyor 9. At Step 106, the compressing means 5 compresses the ends of the stack of articles by having pushers pushing inwards from both opposite ends of the stack. At Step 107, the first folding element 6 folds the bottom flap of the end closure panels of the sleeve 3, whilst the second folding element 7 concurrently pushes the bottom flap upwards in a vertical direction at Step 108. At Step 109, the third folding element 8 pushes the folded bottom flap longitudinally inwards to the sleeve 3 and holds the bottom flap for a predetermined period. At Step 110, the top flap of the end closure panels is folded into the bottom flap and transported to be packaged, stored or distributed.

The present disclosure includes as contained in the appended claims, as well as that of the foregoing description. Although this invention has been described in its preferred form with a degree of particularly, it is understood that the present disclosure of the preferred form has been made only by way of example and that numerous changes in the details of construction and the combination and arrangements of parts may be resorted to without departing from the scope of the invention.

The invention claimed is:

1. A packing apparatus for loading compressible articles, comprising:

loading means for loading a stack of compressible articles into an open ended carton sleeve;

compressing means to compress ends of the stack of articles when loaded into the carton sleeve; and folding means to close the ends of the carton sleeve;

wherein the loading means comprises:

a first clamping arm adapted to clamp one end of the stack of articles sufficiently so that the first clamping arm loads the compressed stack through one end of the carton sleeve; and a second clamping arm adapted to enter an opposite end of the carton sleeve prior to the first clamping arm entering the sleeve;

wherein the second clamping arm clamps the opposite end of the stack prior to the first clamping arm being released from the stack and withdrawn from the carton sleeve;

wherein the second clamping arm is adapted to release and withdraw from the carton sleeve;

wherein the compressing means comprises pushers to press into the carton sleeve onto opposed ends of the loaded stack; and wherein the folding means comprises folding elements to fold end closure panels of the carton sleeve to close the carton.

2. The packing apparatus according to claim 1, further comprising a package feeder for feeding the open ended carton sleeves into a conveyor line.

3. The packing apparatus according to claim 1, wherein the folding elements include a first folding element, a second folding element, and a third folding element.

4. The packing apparatus according to claim 3, wherein the first folding element is a pair of downwardly angled elongate members.

5. The packing apparatus according to claim 3, wherein the first folding element is configured to fold opposing lateral sides of a bottom flap of each end closure panels of the carton sleeve.

6. The packing apparatus according to claim 5, wherein the second folding element is configured to push the bottom flap of the end closure panels of the carton sleeve upwards in a vertical direction.

7. The packing apparatus according to claim 3, wherein the third folding element is configured to push the end closure panels of the carton sleeve and holds the panel in place for a predetermined period.

8. A method of loading compressible articles into a carton sleeve using a packing apparatus according to any one of the preceding claims, comprising the steps of:

loading a stack of compressible articles into an open ended carton sleeve by loading means;

compressing ends of the stack of articles when loaded into the carton sleeve by compressing means; and closing ends of the carton sleeve by folding means;

wherein the loading means comprises:

a first clamping arm adapted to clamp one end of the stack of articles sufficiently so that the first clamping arm loads the compressed stack through one end of the carton sleeve;

a second clamping arm adapted to enter the opposite end of the carton sleeve prior to the first clamping arm entering the sleeve;

wherein the second clamping arm clamps the opposite end of the stack prior to the first clamping arm being released from the stack and withdrawn from the carton sleeve;

wherein the compressing means comprises pushers to press into the carton sleeve onto the opposed ends of the loaded stack; and wherein the folding means comprises folding elements to fold end closure panels of the carton sleeve to close the carton sleeve.

* * * * *